US012221899B2

(12) United States Patent
Ganiger et al.

(10) Patent No.: US 12,221,899 B2
(45) Date of Patent: Feb. 11, 2025

(54) METHODS AND APPARATUSES FOR BLADE LOCKING

(71) Applicant: General Electric Company, Schenectady, NY (US)

(72) Inventors: Ravindra Shankar Ganiger, Bengaluru (IN); Dharmaraj Pachaiappan, Bangalore (IN); Nageswar Rao Ganji, Bengaluru (IN); Arvind Namadevan, Bangalore (IN); Jeffrey D. Carnes, Framingham, MA (US); Charles Eric Lavender, Mason, OH (US); Steven Mark Ballman, West Chester, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/210,347

(22) Filed: Jun. 15, 2023

(65) Prior Publication Data

US 2024/0418092 A1 Dec. 19, 2024

(51) Int. Cl.
*F01D 5/32* (2006.01)
*F01D 5/30* (2006.01)

(52) U.S. Cl.
CPC ..... *F01D 5/326* (2013.01); *F01D 5/3007* (2013.01)

(58) Field of Classification Search
CPC . F01D 5/326; F01D 5/323; F01D 5/32; F01D 5/3007; F01D 5/3023; F01D 5/303; F01D 5/3038; F05D 2260/30; F05D 2260/38
See application file for complete search history.

(56) References Cited

U.S. PATENT DOCUMENTS

| | | | | |
|---|---|---|---|---|
| 6,102,664 | A * | 8/2000 | Nguyen | F01D 5/26 416/500 |
| 6,550,717 | B2 | 4/2003 | Maccready et al. | |
| 8,668,434 | B2 | 3/2014 | Karpman et al. | |
| 10,247,032 | B2 | 4/2019 | Gill et al. | |
| 10,724,432 | B2 | 7/2020 | Shapiro et al. | |
| 10,814,992 | B2 | 10/2020 | Halsey et al. | |
| 10,815,904 | B2 | 10/2020 | Cafaro et al. | |
| 2002/0182081 | A1 * | 12/2002 | Bachofner | F01D 5/32 416/220 R |

(Continued)

FOREIGN PATENT DOCUMENTS

| | | | | |
|---|---|---|---|---|
| EP | 3048256 | A1 * | 7/2016 | F01D 5/30 |
| GB | 2424248 | A * | 9/2006 | F01D 5/3069 |

(Continued)

*Primary Examiner* — Courtney D Heinle
*Assistant Examiner* — Ryan C Clark
(74) *Attorney, Agent, or Firm* — Dinsmore & Shohl LLP

(57) ABSTRACT

A lock lug for inhibiting movement of a plurality of rotor blades includes a body and an engagement mechanism. The body is sized and configured to be received within the rim slot of the rotor disk and defines a dovetail receiving aperture. The engagement mechanism extends from the body and has a retracted configuration configured to allow entry and exit of a dovetail of at least one or more of the plurality of rotor blades into and out of the dovetail receiving aperture and an extended configuration configured to block the dovetail from entering the dovetail receiving aperture.

17 Claims, 11 Drawing Sheets

(56) References Cited

U.S. PATENT DOCUMENTS

| | | | | |
|---|---|---|---|---|
| 2004/0067137 | A1* | 4/2004 | Moroso | F01D 5/323 416/221 |
| 2010/0296936 | A1* | 11/2010 | Wilson | F01D 5/3038 29/889.21 |
| 2012/0114490 | A1* | 5/2012 | Joshi | F01D 5/303 29/889.21 |
| 2012/0315144 | A1* | 12/2012 | Agaram | F01D 5/323 416/220 R |
| 2013/0022451 | A1* | 1/2013 | Aiello | F01D 5/3038 415/142 |
| 2013/0076120 | A1 | 3/2013 | Wagner et al. | |
| 2015/0101347 | A1* | 4/2015 | Potter | F01D 5/3038 416/220 R |
| 2015/0101349 | A1* | 4/2015 | Hansen | F01D 5/32 416/220 R |
| 2016/0097288 | A1* | 4/2016 | Carnell | F01D 5/326 29/889.21 |
| 2016/0245101 | A1* | 8/2016 | Humhauser | F01D 5/32 |
| 2017/0218973 | A1* | 8/2017 | Bishop | F04D 29/34 |
| 2018/0112545 | A1* | 4/2018 | De Gaillard | F01D 5/326 |
| 2018/0179902 | A1* | 6/2018 | Goroshchak | F01D 5/3038 |
| 2018/0195399 | A1* | 7/2018 | Zelmer | F01D 5/32 |
| 2019/0063237 | A1* | 2/2019 | Veluru | F01D 5/32 |
| 2020/0248619 | A1 | 8/2020 | Romero et al. | |
| 2020/0340486 | A1 | 10/2020 | Reynolds et al. | |
| 2021/0254480 | A1* | 8/2021 | Behling | F01D 5/284 |

FOREIGN PATENT DOCUMENTS

| | | | | |
|---|---|---|---|---|
| WO | WO-2008037661 | A1 * | 4/2008 | F01D 5/323 |
| WO | WO-2012131227 | A1 * | 10/2012 | F01D 5/3038 |

* cited by examiner

METHODS AND APPARATUSES FOR BLADE LOCKING

TECHNICAL FIELD

The present specification generally relates to methods, apparatuses, and assemblies for blade locking.

BACKGROUND

Many gas turbine engines include a rotor assembly that includes a rotor disk and an array of rotor blades that extend radially outward from a perimeter of the rotor disk. The rotor blades may be formed separately from the rotor disk and then attached thereto. In particular, in some applications, the rotor blades may be inserted into a rim slot disposed along a circumference of a rotor disk.

In many instances, it may be beneficial to retain the array of rotor blades in a fixed circumferential arrangement such that the rotor disk and the array of rotor blades rotate together in the fixed arrangement. Current devices and apparatuses for retaining an array of rotor blades in a fixed circumferential arrangement relative to the rotor disk are generally single use. In other words, the use of the device in a turbine engine or the removal of the device from the turbine engine renders the device unusable for future engine builds. Accordingly, in many instances, it may be beneficial to include a device for inhibiting movement of a rotor blade assembly within a rim slot of a rotor disk that is capable of reuse.

Moreover, current devices and apparatuses for retaining an array of rotor blades in a fixed circumferential arrangement relative to the rotor disk are generally not self-locking. For example, the device may require a screw or other tool in order to lock the device in place.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
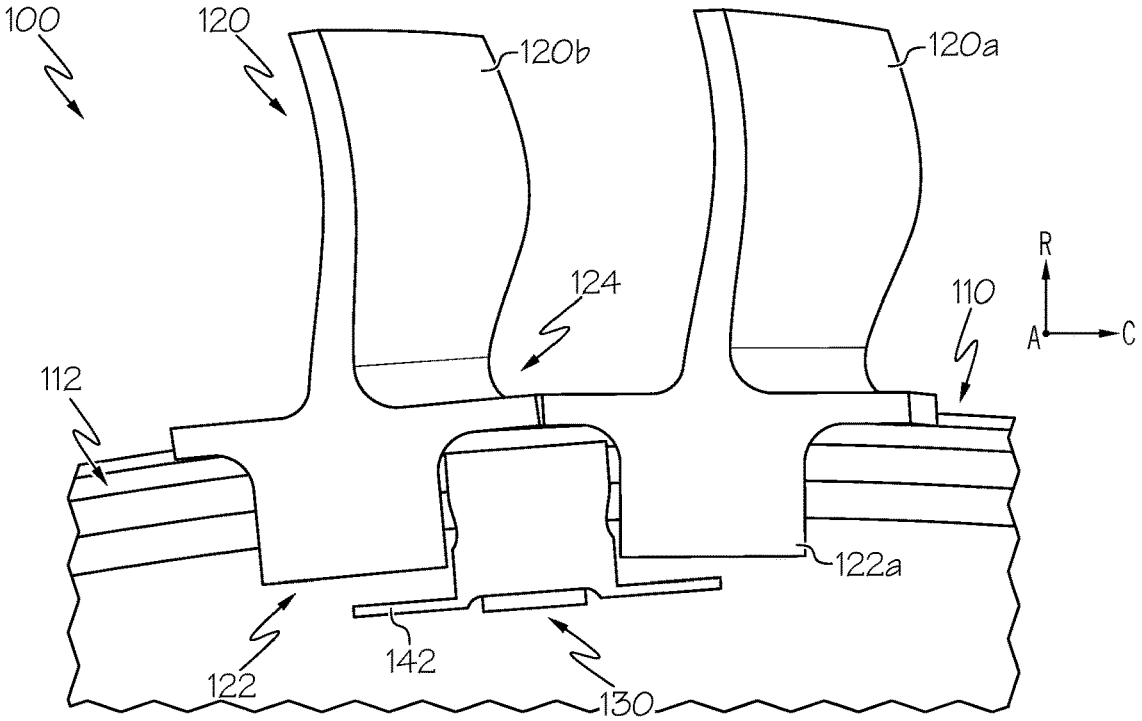
FIG. 1 schematically depicts an axial view of a portion of a rotor assembly, according to one or more embodiments shown and described herein.
Figure 2:
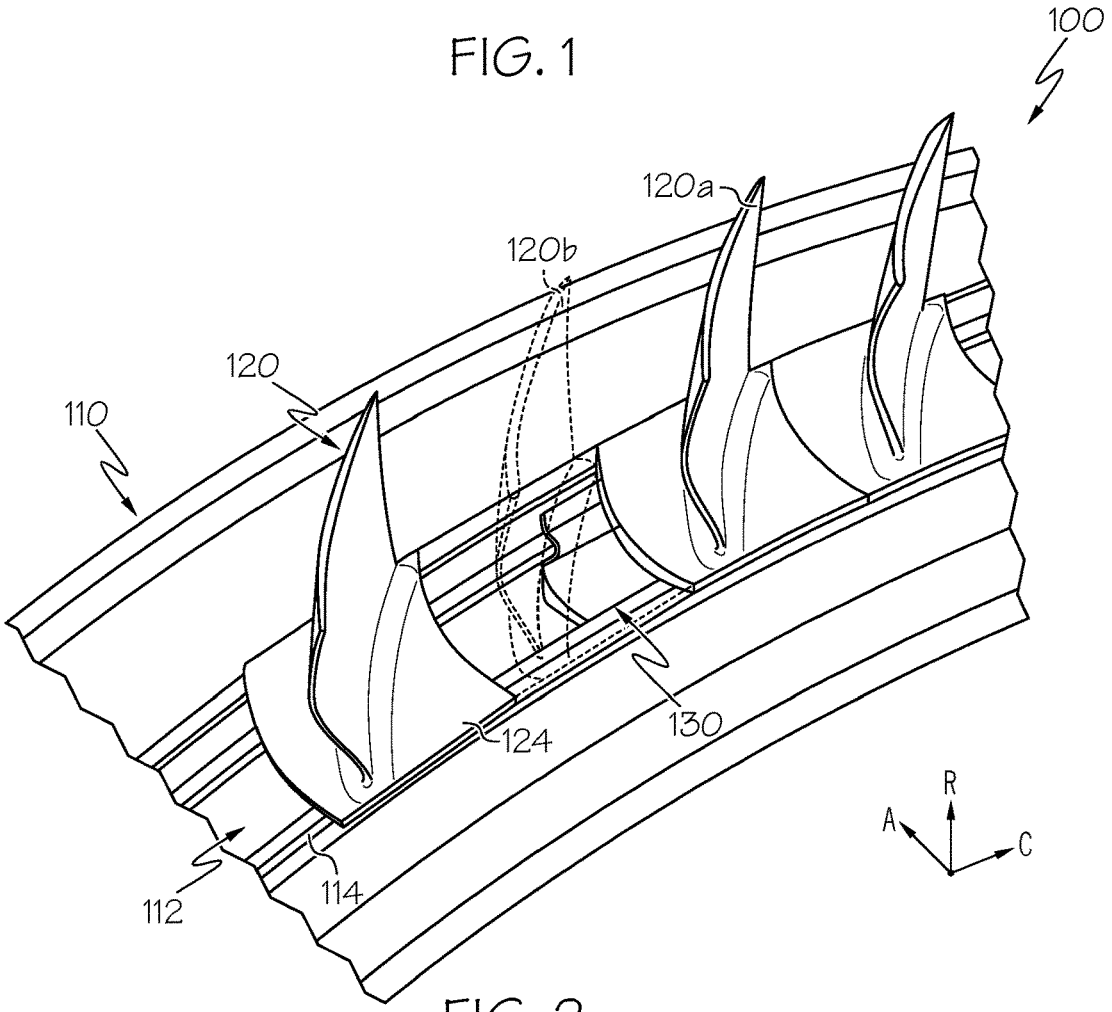
FIG. 2 schematically depicts a top perspective view of a portion of the rotor assembly of FIG. 1, according to one or more embodiments shown and described herein.

Reference will now be made in detail to various embodiments of devices, assemblies, and methods, examples of which are illustrated in the accompanying drawings. Whenever possible, the same reference numerals will be used throughout the drawings to refer to the same or like parts. FIGS. 1 and 2 schematically depict a lock lug for inhibiting movement of a plurality of rotor blades within a rim slot along a circumference of a rotor disk. The lock lug generally includes a body and an engagement mechanism. The body may be sized and configured to be received within the rim slot of the rotor disk. The body may define a dovetail receiving aperture and may be moveable between an assembly position and an engaged position, wherein the dovetail receiving aperture receives a dovetail of the plurality of rotor blades when the body is in the assembly position and is offset from the dovetail when the body is in the engaged position. The engagement mechanism may extend from the body and may be operable to retain the body in the engaged position. The engagement mechanism has a retracted configuration that places the body in the assembly position within the rim slot to allow entry and exit of the dovetail of the plurality of rotor blades into and out of the dovetail receiving aperture and an extended configuration that places the body in the engaged position within the rim slot thereby offsetting the dovetail receiving aperture from the dovetail such that the dovetail is blocked from entering the dovetail receiving aperture.

Directional terms as used herein—for example up, down, right, left, front, back, top, bottom—are made only with reference to the figures as drawn and are not intended to imply absolute orientation unless otherwise specified.

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any device or assembly claim does not actually recite an order or orientation to individual components, or it is not otherwise specifically stated in the claims or description that the steps are to be limited to a specific order, or that a specific order or orientation to components of an device or assembly is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation; and the number or type of embodiments described in the specification.

As used herein, the singular forms "a," "an," and "the" include plural referents unless the context clearly dictates otherwise. Thus, for example, reference to "a" component includes aspects having two or more such components, unless the context clearly indicates otherwise.

Referring to FIGS. 1 and 2 in combination, a section of a rotor assembly 100 is schematically depicted. The rotor assembly 100 generally includes a rotor disk 110, a plurality of rotor blades 120, and a lock lug 130. In embodiments, each of the plurality of rotor blades 120 may comprise a dovetail 122 and a platform 124. The rotor disk 110 may have a rim slot 112 extending about a circumference of the rotor disk 110 (e.g. in the circumferential direction C of the depicted coordinate system) that is configured to receive the plurality of rotor blades 120. For example, the rim slot 112 may have a complementary dovetail shape to receive the dovetails 122 of the plurality of rotor blades 120. As used herein, the terms "dovetail" or "dovetail shape" refer to structures or shapes having a relative wide portion that tapers to a relatively narrow portion in the radial direction. The rotor disk 110 may include a load slot 116 (depicted in phantom in FIG. 11) extending axially (e.g. in the axial direction A of the depicted coordinate system) from the rim slot 112. In this way, the plurality of rotor blades 120 may be inserted into the rim slot 112 one at a time through the load slot 116 and disposed about the circumference of the rotor disk 110. In particular, in embodiments, a final rotor blade 120*a* may be inserted into the rim slot 112 adjacent to a neighboring blade 120*b* after all of the other blades of the plurality of rotor blades 120 have been inserted into the rim slot 112. After the insertion of the final rotor blade 120*a* into the rim slot 112, there may be no gaps or only a small gap disposed between the platforms 124 of the plurality of rotor blades 120.

Figure 3:
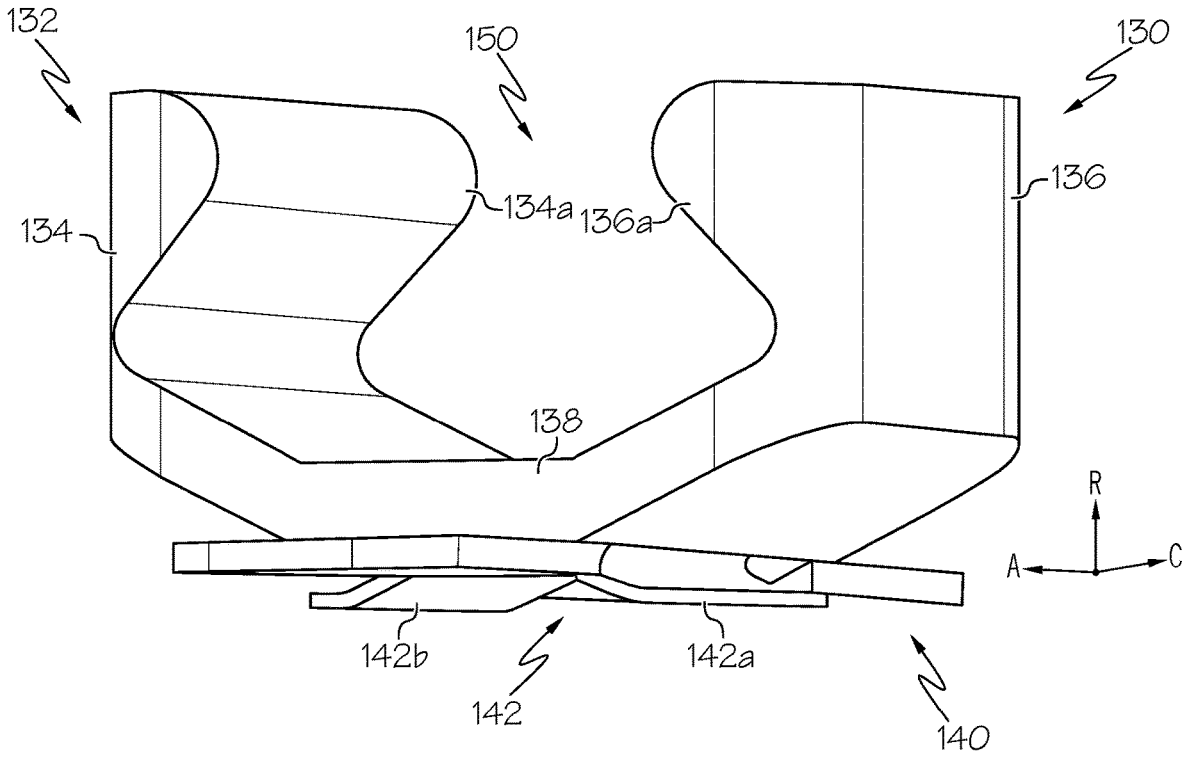
FIG. 3 schematically depicts a perspective view of a lock lug, according to one or more embodiments shown and described herein.

Referring to FIG. 3, the lock lug 130 is schematically depicted. The lock lug 130 may include a body 132 and an engagement mechanism 140 extending from the body 132. The body 132 may include a first sidewall 134 and a second sidewall 136 opposite the first sidewall 134. The body 132 may include a bottom portion 138 extending between the first sidewall 134 and the second sidewall 136. The first sidewall 134, the second sidewall 136, and the bottom portion 138 may be sized and configured such that the lock lug 130 may be received within the rim slot 112 of the rotor disk 110 via the load slot 116 (depicted in phantom in FIG. 11). For example, as shown in FIG. 1, the lock lug 130 is disposed within the rim slot 112 of the rotor disk 110. As will be described in greater detail herein, the lock lug 130 may be sized to extend into the load slot 116 (depicted in phantom in FIG. 11) when disposed within the rim slot 112 such that the lock lug 130 may not rotate about the rim slot 112. Entry and retention of the lock lug 130 within the load slot 116 may be beneficial in some embodiments as the lack of circumferential movement of the lock lug 130 may reduce the risk of misalignment of the lock lug 130 as compared to conventional locking mechanisms. Additionally, entry and retention of the lock lug 130 within the load slot 116, which may also be used for entry of the plurality of rotor blades 120, may decrease the complexity of the rotor assembly 100, as a specific slot for the lock lug 130 is not required.

The first sidewall 134 and the second sidewall 136 may define a dovetail receiving aperture 150, disposed therebetween. More specifically, in some embodiments, the first sidewall 134 may have an inner surface 134*a* that is shaped complementary to the dovetails 122 of the plurality of rotor blades 120. Similarly, the second sidewall 136 may have an inner surface 136*a* that is shaped complementary to the dovetails 122 of the plurality of rotor blades 120. Accordingly, one of the dovetails 122 may be received within the dovetail receiving aperture 150 defined by the first sidewall 134 and the second sidewall 136. The body 132 may be made from any appropriate material such as metal, metal alloy, or composite material. The body 132 may be solid or may be partially or wholly hollow. For example, in some embodiments, the body 132 may be hollow at the first sidewall 134 and the second sidewall 136. In some embodiments, the body 132 may be additively manufactured.

Referring to FIGS. 1 and 3 in combination, the lock lug 130 may include tabs 144 that may extend circumferentially from the body 132 (e.g. in the C direction of the depicted cylindrical coordinate system). The tabs 144 may extend beneath the rotor blades 120 when the lock lug 130 is assembled, such as depicted in FIG. 1. Accordingly, the tabs 144 may align the lock lug 130 in the appropriate radial position during assembly.

Referring to FIG. 3, the lock lug 130 may include an engagement mechanism 140 extending from the body 132. In some embodiments, and as depicted, the engagement mechanism 140 may extend outwardly from the bottom portion 138 (e.g. in the −R direction of the depicted coordinate system). However, as will be described in greater detail herein, in other embodiments the engagement mechanism 140 may extend from other surfaces of the body 132. In some embodiments, the engagement mechanism 140 may be integrally formed with body 132 of the lock lug 130. On other embodiments, the engagement mechanism 140 may be coupled to the body 132 via a screw, bolt, adhesive, weld, braze, or other joining mechanism.

The engagement mechanism 140 may include one or more springs 142, such as a first spring 142*a* and a second spring 142*b*. As depicted, the one or more springs 142 may be tabs extending from the body 132. However, other shapes are contemplated and possible. For example, in some embodiments the one or more springs 142 may have an arced or coiled spring shape.

The engagement mechanism 140 may be moveable between an extended configuration and a retracted configuration. As depicted in FIG. 3, in the extended configuration, the one or more springs 142 may extend from the body 132 in a radial direction (e.g. in the −R direction of the depicted coordinate system). As depicted in FIG. 1, in the retracted configuration, the one or more springs 142 may be compressed in the radial direction (e.g. in the R direction of the depicted coordinate system). The engagement mechanism 140 may be biased toward the extended configuration. For example, in some embodiments, the one or more springs 142 may consist of a spring material, such as spring steel, or a memory metal, such as nitinol, such that the one or more springs 142 are spring loaded toward the extended configuration. The one or more springs 142 may be the same material or a different material than the body 132.

Figure 4:
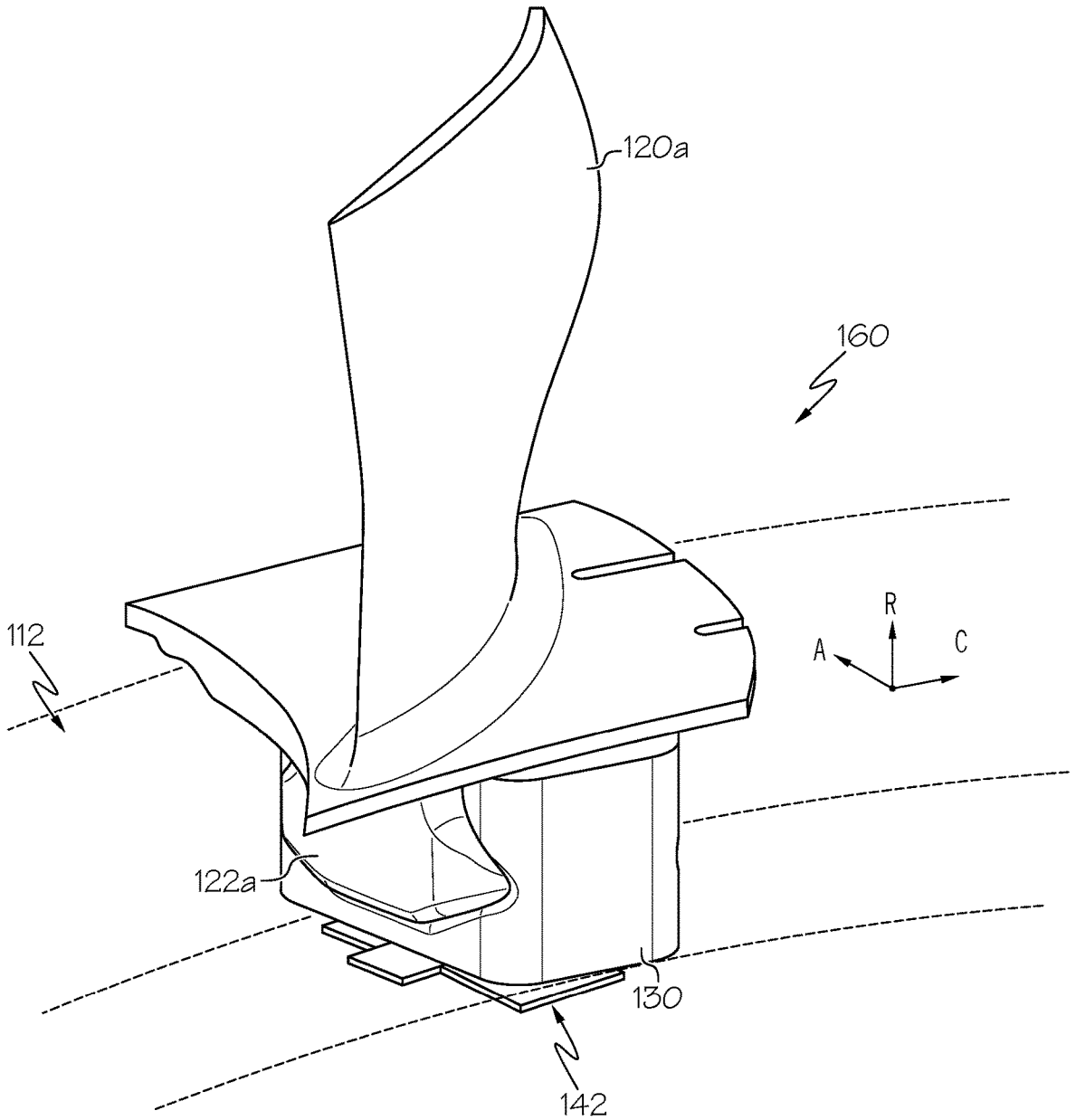
FIG. 4 schematically depicts a perspective view of the lock lug of FIG. 3 with a rotor blade, according to one or more embodiments shown and described herein.

Referring to FIG. 4, the body 132 of the lock lug 130 is schematically depicted in an assembly position. As depicted, a dovetail 122*a* of the final rotor blade 120*a* may be received within the dovetail receiving aperture 150 of the lock lug 130 when the body 132 is in the assembly position. Accordingly, in this orientation, the final rotor blade 120*a* and the lock lug 130 may form a rotor blade and lock lug assembly 160. The rotor blade and lock lug assembly 160 may be inserted into the rim slot 112 (depicted in phantom) via the load slot 116 as a single unit. As depicted, when the rotor blade and lock lug assembly 160 is inserted into the rim slot 112, the lock lug 130 may be sandwiched between the rim slot 112 and the dovetail 122*a*. Accordingly, when the rotor blade and lock lug assembly 160 is inserted into the rim slot 112, the lock lug 130 may be held in the retracted configuration with the dovetail receiving aperture 150 aligned with the dovetail 122*a*.

Figure 5A:
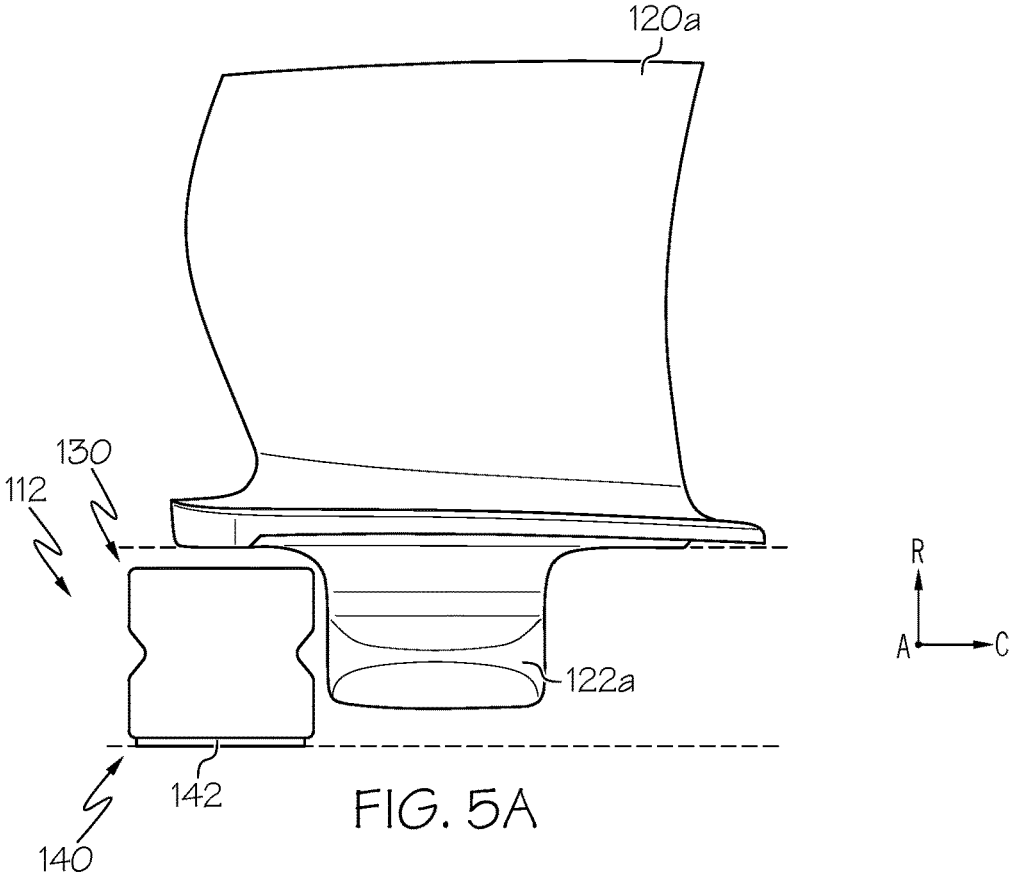
FIG. 5A schematically depicts an axial view of the lock lug and the rotor blade of FIG. 4, according to one or more embodiments shown and described herein.
Figure 5B:
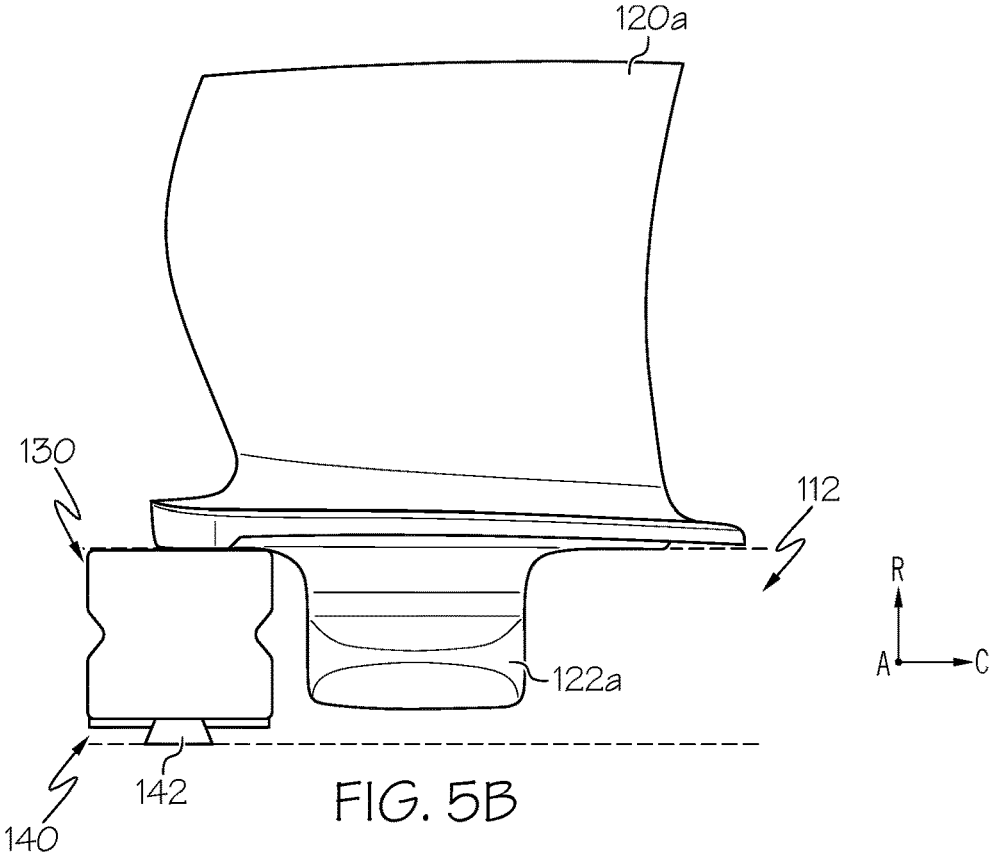
FIG. 5B schematically depicts an axial view of the lock lug and the rotor blade of FIG. 4, according to one or more embodiments shown and described herein.

Referring collectively to FIGS. 5A-B, the engagement mechanism 140 is schematically depicted as moving from the retracted configuration (depicted in FIG. 5A) to the extended configuration (depicted in FIG. 5B). In a similar manner, the body 132 is depicted as moving from the assembly position (depicted in FIG. 5A) to the engaged position (depicted in FIG. 5B). When in the assembly position (depicted in FIG. 5A), the dovetail 122*a* may be moved into and out of the dovetail receiving aperture 150 due to the alignments of the dovetail receiving aperture 150 with the dovetail 122*a*. As will be described in greater detail herein, when in the engaged position, the dovetail receiving aperture 150 of the body 132 may be maintained in a position offset from the dovetail 122*a* such that the dovetail 122*a* is blocked from entering the dovetail receiving aperture 150.

As depicted particularly in FIG. 5B, in embodiments, the dovetail receiving aperture 150 of the body 132 may be maintained in a position that is both radially offset (e.g. in the R direction of the depicted coordinate system) from the dovetail 122*a* and circumferentially offset (e.g. in the C direction of the depicted coordinate system) from the dovetail 122*a*. However, as will be described herein, in other embodiments, the dovetail receiving aperture 150 of the body 132 may be maintained in a position that is only circumferentially offset (e.g. in the C direction of the depicted coordinate system) from the dovetail 122*a*. More specifically, in some embodiments, the dovetail receiving aperture 150 of the body 132 may be maintained in a position circumferentially offset from the dovetail 122*a* such that the dovetail 122*a* is blocked from entering the dovetail receiving aperture 150 even when the dovetail receiving aperture 150 and the dovetail 122*a* are radially aligned (e.g. in the R direction of the depicted coordinate system).

Still referring collectively to FIGS. 5A-B, once inserted into the rim slot 112 (depicted in phantom in FIGS. 5A-B), the final rotor blade 120*a* may be moved circumferentially (e.g. in the +C direction of the depicted coordinate system) while the lock lug 130 remains in place such that the dovetail 122*a* exits the dovetail receiving aperture 150. In particular, the lock lug 130 may be sized to extend into the load slot 116 (depicted in phantom in FIG. 9) such that it remains in place within the load slot 116. Accordingly, the lock lug 130 may remain in place, and the final rotor blade 120*a* and lock lug assembly 160 will become separated. As shown in FIGS. 5A and 5B, the final rotor blade 120*a* is rotated circumferentially as compared to FIG. 4 and is removed from the dovetail receiving aperture 150 of the lock lug 130.

Once the final rotor blade 120*a* is moved circumferentially (e.g. in the +C direction of the depicted coordinate system), the lock lug 130 may no longer be radially confined (e.g. in the R direction of the depicted coordinate system) by the dovetail 122*a*. Accordingly, the engagement mechanism 140 of the lock lug 130 may move into the extended configuration. As shown in FIG. 5A, the engagement mechanism 140 is initially in the retracted position, and, as shown in FIG. 5B, the engagement mechanism 140 may move into the extended configuration once the dovetail 122*a* is removed from the dovetail receiving aperture 150. As the engagement mechanism 140 moves into the extended configuration, the body 132 may be moved from the assembly position into the engaged position. As shown in FIG. 5B, the body 132 is positioned in the engaged position. As depicted, in some embodiments, the engaged position may be radially raised (e.g. in the +R direction of the depicted coordinate system) relative to the assembly position.

Figure 6:
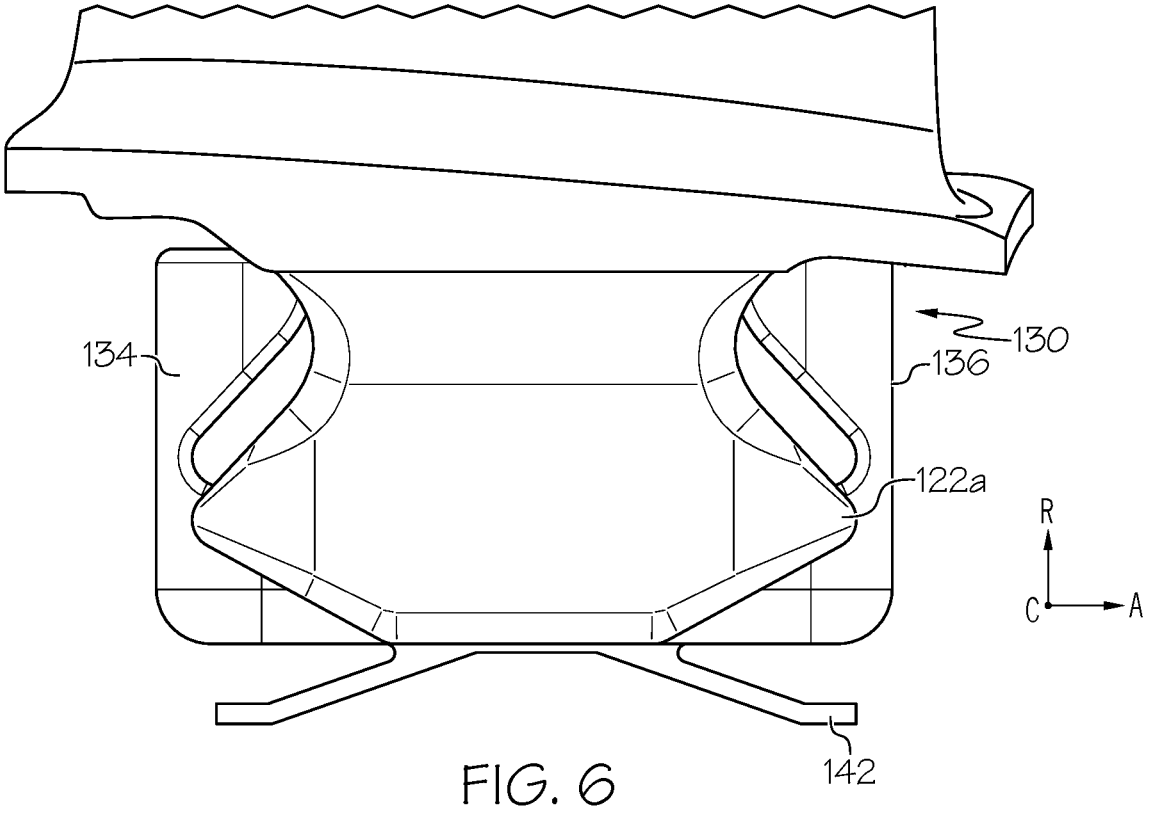
FIG. 6 schematically depicts a partial circumferential view of the lock lug and the rotor blade of FIG. 4, according to one or more embodiments shown and described herein.

Referring now to FIG. 6, when in the engaged position, the dovetail 122*a* and the dovetail receiving aperture 150 of the body 132 may be offset. Accordingly, the dovetail 122*a* may be prevented from moving in the direction of the lock lug 130 (e.g. in the +C direction of the depicted coordinate system, directed into the page). In particular, as depicted, the bottom portion 138 of the lock lug 130 may be aligned with the dovetail 122*a* such that the bottom portion 138 of the body 132 inhibits movement of the dovetail 122*a*. In a similar manner, referring back to FIGS. 1 and 2, the lock lug 130 may prevent the neighboring blade 120*b* from moving in the direction of the lock lug 130 (e.g. in the −C direction of the depicted coordinate system). Accordingly, it will now be appreciated that the lock lug 130 may inhibit circumferential movement of the plurality of rotor blades 120 within the rim slot 112 of the rotor disk 110. In some embodiments, the rotor assembly 100 may include more than lock lug 130. For example, the rotor assembly 100 may include the lock lug 130 and a second lock lug (not depicted) spaced apart from the lock lug 130 at a second load slot (not depicted).

Figure 7:
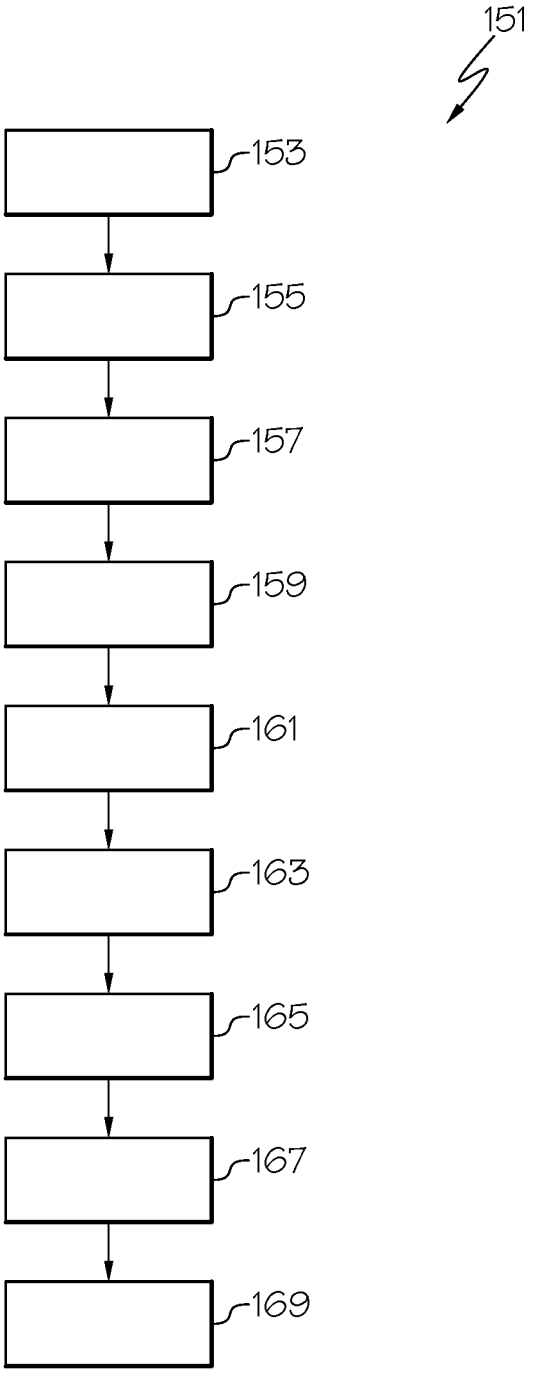
FIG. 7 depicts a method of assembling and disassembling a rotor disk using the locking lugs described, according to one or more embodiments shown and described herein.

Referring to FIG. 7 and in light of FIGS. 1-6, it will now be appreciated that a method 151 of assembly of the rotor assembly 100 may include inserting all of the rotor blades 120 apart from the final rotor blade 120*a* into the rim slot 112 via the load slot 116 (depicted in phantom in FIG. 9) at step 153. The method of assembly may then include inserting the rotor blade and lock lug assembly 160, comprising both the final rotor blade 120*a* and the lock lug 130 in the assembly position, into the rim slot 112 via the load slot 116 at step 155. The method of assembly may further include rotating the final rotor blade 120*a* circumferentially such that the dovetail 122*a* of the final rotor blade 120*a* is no longer disposed within the lock lug 130 at step 157. Accordingly, the engagement mechanism 140 of the lock lug 130 may move from the retracted configuration to the extended configuration, which may cause the body 132 of the lock lug 130 to move from the assembly position to the engaged position at step 159. In this way, the lock lug 130 may inhibit movement of the rotor blades 120 circumferentially within the rim slot 112 at step 161.

In light of FIGS. 1-6, it will now be appreciated that the method 151 may include steps of disassembling of the rotor assembly 100 that includes depressing the lock lug 130 such that the engagement mechanism 140 moves from the extended configuration to the retracted configuration causing the body 132 of the lock lug 130 to move from the engaged position to the assembly position at step 163. The method of disassembly may then include rotating the final rotor blade 120*a* circumferentially such that the dovetail 122*a* of the final rotor blade 120*a* is disposed within the dovetail receiving aperture 150 of the lock lug 130 at step 165. Accordingly, the final rotor blade 120*a* and the lock lug 130 may again form the rotor blade and lock lug assembly 160. The rotor blade and lock lug assembly 160 may then be removed from the rim slot 112 via the load slot 116 at step 167. The rotor blades 120 may then also be removed from the rim slot 112 via the load slot 116 at step 169.

As described above, the method of disassembly of the rotor assembly 100 may include depressing the lock lug 130 such that engagement mechanism 140 of the lock lug 130 moves from the extended configuration to the retracted configuration. In some embodiments, the lock lug 130 may be depressed by inserting a tool (not depicted) through a gap in the platforms 124. The tool (not depicted) may impart a downward force (e.g. in the −R direction of the depicted coordinate system) such that the lock lug 130 is depressed. However, as will be described in greater detail presently, other methods of depressing the lock lug 130 are contemplated and possible. As will now be appreciated, the lock lug 130 may be assembled and disassembled without requiring screws or other tools which may limit the ability to reuse the lock lug 130. Accordingly, the lock lug 130 may be reusable. Additionally, the lock lug 130 may be assembled and disassembled without circumferential rotation of the lock lug 130, which may reduce the risk of misalignment or miss-assembly of the lock lug 130.

Figure 8:
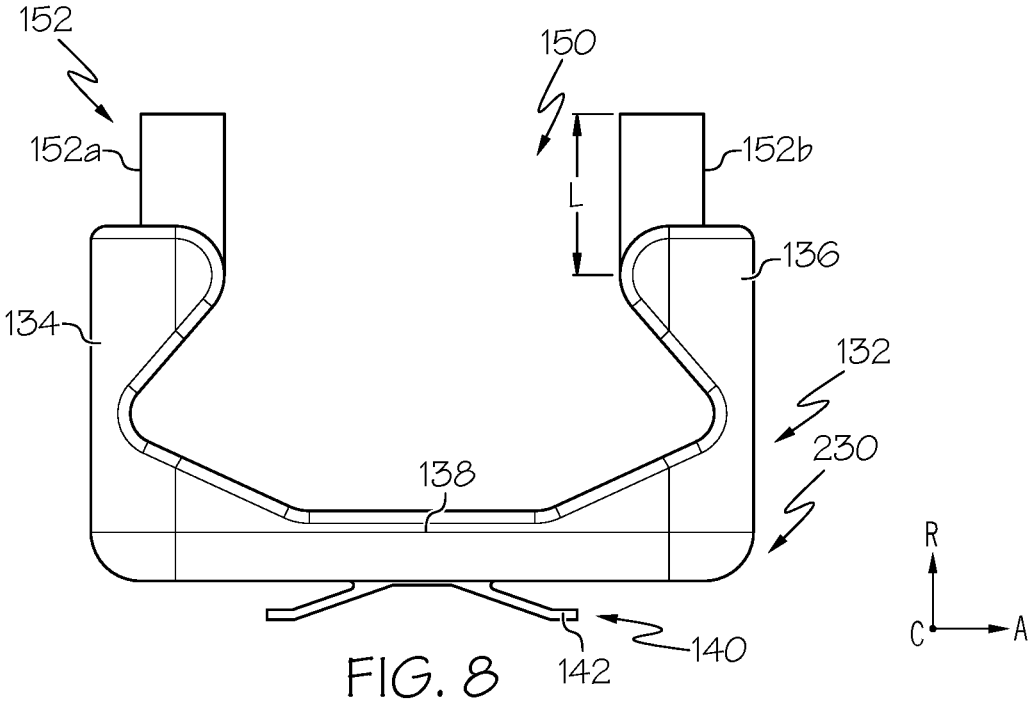
FIG. 8 schematically depicts a circumferential view of a lock lug, according to one or more embodiments shown and described herein.

Referring now to FIG. 8, an embodiment of a lock lug 230 is depicted schematically. The lock lug 230 is substantially similar to the lock lug 130 described above. Accordingly, like numbers are used to refer to like features. For example, the lock lug 230 may have a body 132 and an engagement mechanism 140 such as described above. The lock lug 230 may have one or more standoffs 152 extending radially outward (e.g. in the +R direction of the depicted coordinate system) from the body 132. In particular, as depicted in FIG. 8, in some embodiments, the one or more standoffs 152 may include a first standoff 152*a* and a second standoff 152*b*. The first standoff 152*a* may extend from the first sidewall 134, and the second standoff 152*b* may extend from the second sidewall 136. The one or more standoffs 152 may extend a length L outward from the body 132. As depicted, the one or more standoffs 152 may be substantially cylindrical along the length L. However, other shapes are contemplated and possible. For example, in some embodiments, the one or more standoffs 152 may have an ovular, square, or irregular or regular polygonal shaped cross section. In some embodiments, the one or more standoffs 152 may have a tapered geometry or an otherwise variable geometry along the length L.

Still referring to FIG. 8, in some embodiments, the length L of the one or more standoffs 152 may extend up to or past the platforms 124 of the rotor blades 120 when the lock lug 130 is in the engaged position. In some embodiments, the one or more standoffs 152 may extend into or past a gap disposed between the platforms 124 of the rotor blades 120. In some embodiments, and particularly in embodiments wherein no gap or only a small gap exists between the platforms 124 of the rotor blades 120, the platforms 124 may define one or more platform notches 126 (depicted, for example, in FIG. 10) disposed within the platforms 124. The one or more platform notches 126 may be sized and positioned such that the one or more standoffs 152 may extend through the one or more platform notches 126 when the rotor blades 120 and the lock lug 230 are assembled within the rim slot 112. Accordingly, the one or more standoffs 152 may be viewable and accessible when the rotor assembly 100 is fully assembled.

Figure 9:
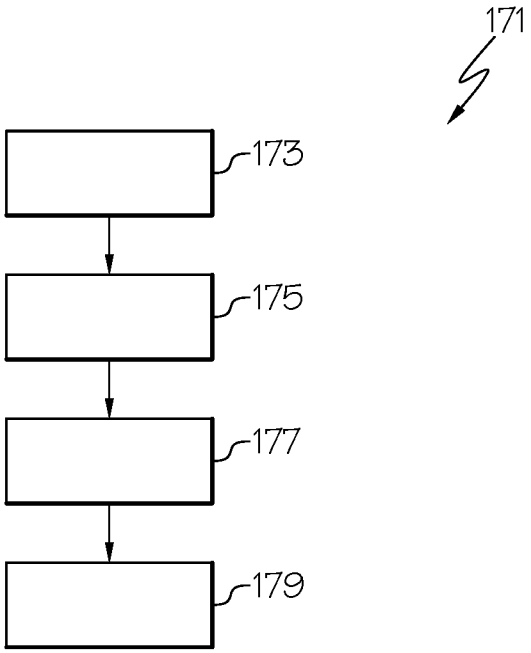
FIG. 9 depicts a method of disassembling a rotor disk using the locking lugs described, according to one or more embodiments shown and described herein.

Referring to FIG. 9 and in light of FIG. 8, it will be appreciated that, in some embodiments, a method 171 of disassembling the rotor assembly 100 may include exerting a downward force (e.g. in the −R direction of the depicted coordinate system) on the one or more standoffs 152 of the lock lug 230 at step 173. The downward force may cause the engagement mechanism 140 of the lock lug 230 to move from the extended configuration to the retracted configuration causing the body 132 of the lock lug 130 to move from the engaged position to the assembly position at step 175. The method of disassembly may then include rotating the final rotor blade 120*a* circumferentially such that the dovetail 122*a* of the final rotor blade 120*a* is disposed within the dovetail receiving aperture 150 of the lock lug 230 at step 177. The method of disassembly may then include removing the final rotor blade 120*a* and the lock lug 230 through the load slot 116 at step 179 such as described above.

Figure 10:
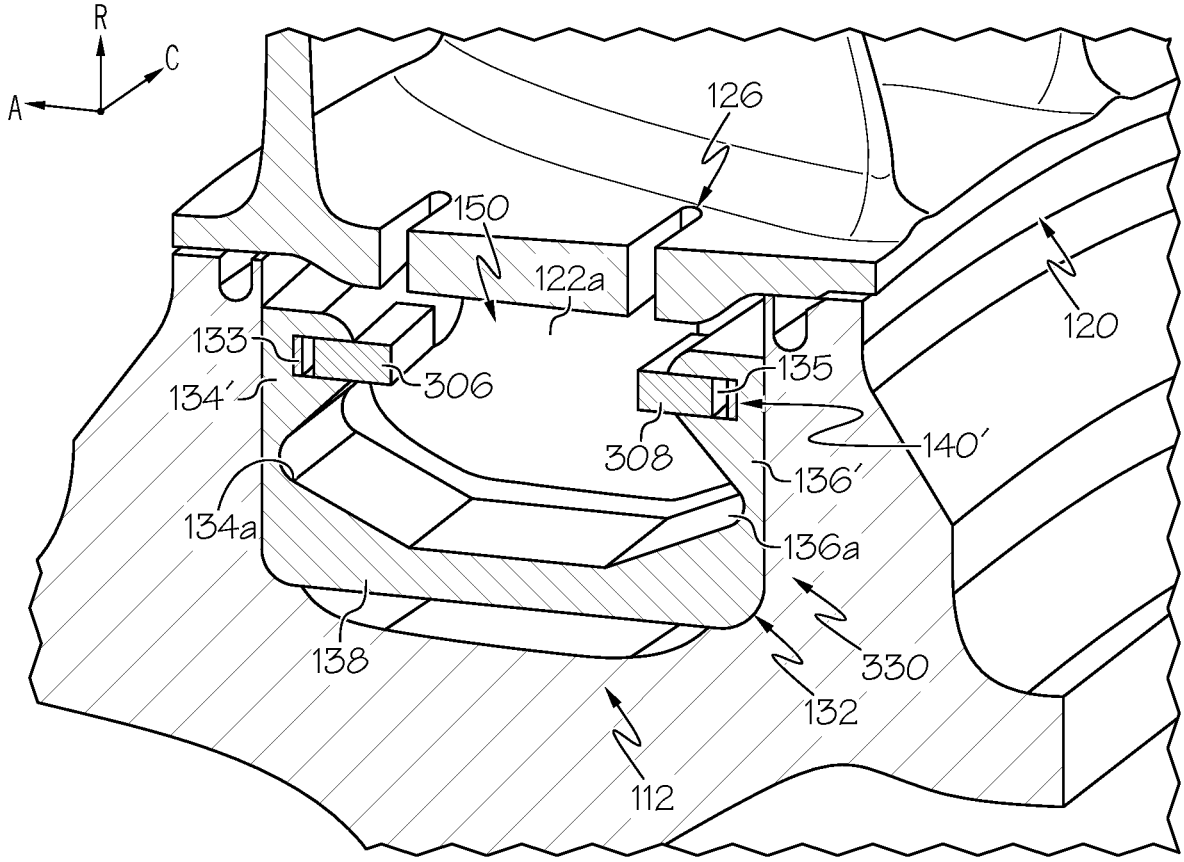
FIG. 10 schematically depicts a perspective view of a portion of a rotor assembly, according to one or more embodiments shown and described herein.

Referring now to FIG. 10, an embodiment of a lock lug 330 is schematically depicted. The lock lug 330 is substantially similar to the lock lugs 130 and 230 described above. Accordingly, like numbers are used to refer to like features. For example, the lock lug 330 may have a body 132 including a first sidewall 134' and a second sidewall 136'. The first sidewall 134' and the second sidewall 136' may each have an inner surface 134*a* and 136*a*, respectively. The first sidewall 134' may have a slot 133 extending inward (e.g. in the +A direction of the depicted coordinate system) from the inner surface 134*a*. Similarly, the second sidewall 136' may have a slot 135 extending inward (e.g. in the −A direction of the depicted coordinate system) from the inner surface 136*a*.

Figure 11:
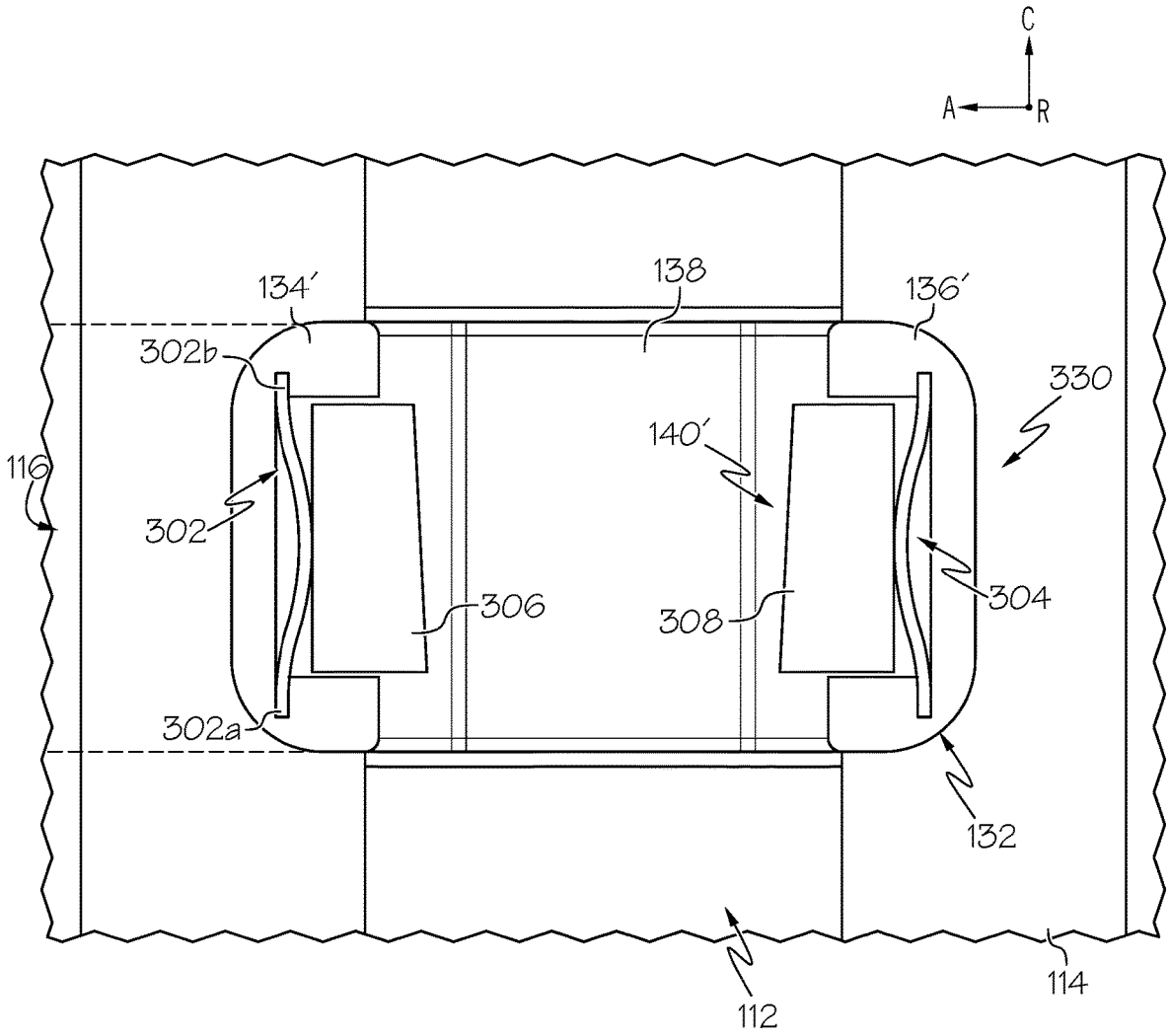
FIG. 11 schematically depicts a top cross sectional view of a lock lug, according to one or more embodiments shown and described herein.

Referring to FIGS. 10 and 11 in combination, the lock lug 330 may include an engagement mechanism 140' extending from the body 132. In particular, the engagement mechanism 140' may extend outward from the inner surface 134*a* of the first sidewall 134' (e.g. in the −A direction of the depicted coordinate system) and outward from the inner surface 136*a* of the second sidewall 136' (e.g. in the +A direction of the depicted coordinate system). In some embodiments, the engagement mechanism 140' may be disposed or partially disposed within the slots 133 and 135. The engagement mechanism 140' may be moveable between an extended configuration and a retracted configuration and may be biased toward the extended configuration.

The engagement mechanism 140' may include a first spring 302. As depicted, the first spring 302 may extend between a first end 302*a* and a second end 302*b*. The first end 302*a* and the second end 302*b* may be coupled to the first sidewall 134' and disposed within the slot 133. In embodiments, the first end 302*a* and the second end 302*b* may be disposed within a receiving aperture of the first sidewall 134', welded to the first sidewall 134', brazed to the first sidewall 134', or otherwise permanently or selectively coupled to the first sidewall 134' within the slot 133. In some embodiments, the first end 302*a* and the second end 302*b* may be coupled to the first sidewall 134' in different ways. For example, the first end 302*a* may be brazed to the first sidewall 134' while the second end 302*b* is selectively disposed within a receiving aperture of the first sidewall 134'. Between the first end 302*a* and the second end 302*b*, the first spring 302 may be generally arced. Accordingly, the first spring 302 may extend outwardly from, or away from, the first sidewall 134' (e.g. in the −A direction of the depicted coordinate system) when in the extended configuration, such as depicted. When in the retracted configuration, the first spring 302 may be retracted toward the first sidewall 134' (e.g. in the +A direction of the depicted coordinate system).

The engagement mechanism 140' may include a second spring 304. The second spring 304 may be substantially similar to the first spring 302 and may be similarly coupled to the second sidewall 136' within the slot 135. Accordingly, the second spring 304 may extend outwardly from, or away from, the second sidewall 136' (e.g. in the +A direction of the depicted coordinate system) when in the extended configuration, such as depicted. When in the retracted configuration, the second spring 304 may be retracted toward the second sidewall 136' (e.g. in the −A direction of the depicted coordinate system).

Still referring to FIGS. 10 and 11, the engagement mechanism 140' may include a first spacer 306. The first spacer 306 may be disposed or partially disposed within the slot 133 of the first sidewall 134'. As depicted, the first spacer 306 may be positioned adjacent to the first spring 302 such that a movement of the first spring 302 may cause a movement of the first spacer 306. The first spacer 306 may be positioned outward relative to the first spring 302 (e.g. in the −A direction of the depicted coordinate system). In some embodiments, the first spacer 306 may be coupled to the first spring 302 such that the first spacer 306 is moveable with the first spring 302. For example, in some embodiments, the first spring 302 may be coupled to the first spacer 306 via weld, braze, adhesive, or magnetic coupling. In other embodiments, the first spacer 306 may be integrally formed with the first spring 302. In still other embodiments, the first spacer 306 may contact the first spring 302 without additional coupling. The first spacer 306 may be any angular, curved, or any regular or irregular shape. In some embodiments, the first spacer 306 may be trapezoidal, such as depicted, which may allow a dovetail 122*a* to be more easily inserted into the lock lug 330 during assembly. As will now be appreciated, in embodiments, the first spacer 306 may extend outward (e.g. in the −A direction of the depicted coordinate system) when the first spring 302 moves into the extended configuration. Relatedly, the first spacer 306 may cause the first spring 302 to move toward the retracted position when the first spacer 306 is pushed or retracted inward (e.g. in the +A direction of the depicted coordinate system).

The engagement mechanism 140' may include a second spacer 308. The second spacer 308 may be substantially similar to the first spacer 306 and may be similarly disposed or partially disposed within the slot 135 of the second sidewall 136' and adjacent to the second spring 304. Accordingly, in embodiments, the second spacer 308 may extend outward (e.g. in the +A direction of the depicted coordinate system) when the second spring 304 moves into the extended configuration. Relatedly, the second spacer 308 may cause the second spring 304 to move toward the retracted position when the second spacer 308 is pushed or retracted inward (e.g. in the −A direction of the depicted coordinate system).

Referring to FIG. 10, the engagement mechanism 140' is depicted in the extended configuration, and the body 132 of the lock lug 330 is in the engaged position. As shown, in some embodiments, when the engagement mechanism 140' is in the extended configuration, the first spacer 306 and/or the second spacer 308 may extend into the dovetail receiving aperture 150 of the lock lug 330. Accordingly, the body 132 of the lock lug 330 may be in the engaged position, wherein the dovetail receiving aperture 150 of the body 132 is maintained in a position that is circumferentially offset from the dovetail 122*a* (e.g. in the C direction of the depicted coordinate system). In this position, the dovetail 122*a* is blocked from entering the dovetail receiving aperture 150 and may instead be maintained in a position adjacent the dovetail 122*a*. In this way, the lock lug 330 when assembled within the rotor assembly 100 may inhibit circumferential rotation of the rotor blades 120.

Referring to FIG. 11, in some embodiments, a portion of the body 132 of the lock lug 330 may extend into the load slot 116 when assembled into the rotor assembly 100. For example, as depicted, the first sidewall 134' may extend into the load slot 116 when assembled into the rotor assembly 100. This orientation may assist with inhibiting rotation of the plurality of rotor blades 120 about the circumference of the rotor disk 110. In some embodiments, the rotor assembly 100 may have more than one load slot 116. For example, the rotor assembly 100 may have a first load slot and a second load slot positioned circumferentially opposite the first load slot. In embodiments having more than one load slot 116, the rotor assembly 100 may similarly have more than one lock lug 330 such that each load slot 116 has a corresponding lock lug 330.

Figure 12:
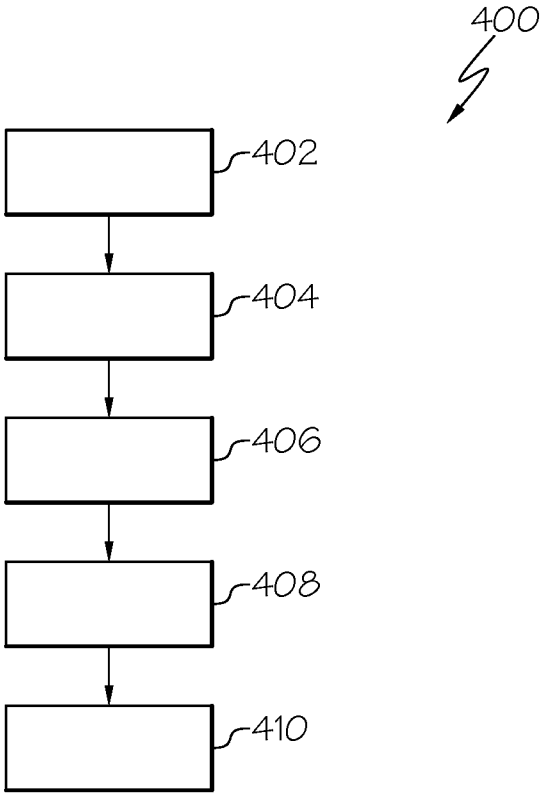
FIG. 12 depicts a method of assembling and disassembling a rotor disk using the locking lugs described, according to one or more embodiments shown and described herein.

Referring to FIG. 12 and in light of FIGS. 10 and 11, it will now be appreciated that methods 400 of assembling of a rotor assembly 100 having a lock lug 330 may be substantially similar to the methods of assembly described in relation to the lock lug 130 above. In particular, the lock lug 330 may be assembled in the assembly position with a dovetail 122*a* disposed within the dovetail receiving aperture 150 at step 402. The dovetail 122*a* may then be rotated circumferentially (e.g. in the C direction of the depicted coordinate system) such that it is removed from the dovetail receiving aperture and, accordingly, offset from the dovetail receiving aperture 150 (e.g. in the C direction of the depicted coordinate system) at step 404. The engagement mechanism 140' of the lock lug 330 may then move from the retracted configuration to the extended configuration once the dovetail 122*a* is removed from the dovetail receiving aperture 150 causing the body 132 of the lock lug 330 to be in the engaged position at step 406. Accordingly, the lock lug 330 may be self-locking.

In light of FIGS. 10 and 11, the method 400 may include steps of disassembly of the rotor assembly 100 including moving the engagement mechanism 140' from the extended configuration to the retracted configuration causing the body 132 of the lock lug 330 to enter the assembly position wherein the dovetail receiving aperture 150 may receive the dovetail 122*a* at step 408. In particular, in some embodiments, a tool may be inserted through a gap in the platforms 124 or through one or more platform notches 126 disposed in the platforms 124, such as depicted. Accordingly, the dovetail 122*a* may be rotated such that it is disposed within the dovetail receiving aperture 150. The lock lug 330 may then be disassembled through the load slot 116 at step 410.

In view of the above, it should now be understood that at least some embodiments of the present disclosure are directed to a lock lug for inhibiting movement of a plurality of rotor blades within a rim slot along a circumference of a rotor disk. The lock lug generally includes a body and an engagement mechanism. The body is sized and configured to be received within the rim slot of the rotor disk. The body defines a dovetail receiving aperture and is moveable between an assembly position and an engaged position, wherein the dovetail receiving aperture receives a dovetail of the plurality of rotor blades when the body is in the assembly position and is offset from the dovetail when the body is in the engaged position. The engagement mechanism extends from the body and is operable to retain the body in the engaged position. The engagement mechanism has a retracted configuration that places the body in the assembly position within the rim slot to allow entry and exit of the dovetail of the plurality of rotor blades into and out of the dovetail receiving aperture and an extended configuration that places the body in the engaged position within the rim slot offsetting the dovetail receiving aperture from the dovetail such that the dovetail is blocked from entering the dovetail receiving aperture.

The above-described locking lugs can provide locking means for blocking a dovetail of the plurality of rotor blades from exiting the rim slot and self-locking arrangements where the locking lugs are biased toward engaged positions that, once placed in the engaged positions, the locking lugs effectively trap the dovetails of a plurality of rotor blades within rim slots of rotor disks. The locking lugs trap the dovetails by offsetting dovetail receiving apertures from the dovetails so that the dovetails cannot enter the dovetail receiving apertures. In order to release the dovetails from the rim slots, the locking lugs can be moved into assembly positions which align the dovetail receiving apertures with the dovetails, which allows for their removal from the rim slots. The self-locking arrangement of the locking lugs can simplify assembly and disassembly of the rotor disk and rotor blades compared to current locking arrangements.

Further aspects are provided by the subject matter in the following clauses:

Clause 1: A lock lug for inhibiting movement of a plurality of rotor blades within a rim slot along a circumference of a rotor disk includes a body and an engagement mechanism. The body is sized and configured to be received within the rim slot of the rotor disk and defines a dovetail receiving aperture. The engagement mechanism extends from the body and has a retracted configuration and an extended configuration. The retracted configuration is configured to allow entry and exit of a dovetail of at least one or more of the plurality of rotor blades into and out of the dovetail receiving aperture. The extended configuration is configured to block the dovetail from entering the dovetail receiving aperture.

Clause 2: The lock lug of any of the above clauses, wherein the engagement mechanism includes a spring, wherein the spring biases the engagement mechanism toward the extended configuration.

Clause 3: The lock lug of any of the above clauses, wherein the engagement mechanism extends from a bottom portion of the body and biases the body radially outward.

Clause 4: The lock lug of any of the above clauses, wherein the engagement mechanism includes a spring, wherein the spring extends outward from the body when the engagement mechanism is in the extended configuration.

Clause 5: The lock lug of any of the above clauses, wherein the lock lug includes a standoff extending radially upward from the body, wherein the standoff is operable to move the engagement mechanism from the extended configuration to the retracted configuration when depressed.

Clause 6: The lock lug of any of the above clauses, wherein the engagement mechanism extends from a sidewall of the body.

Clause 7: The lock lug of any of the above clauses, wherein the engagement mechanism extends into the dovetail receiving aperture.

Clause 8: The lock lug of any of the above clauses, wherein the engagement mechanism comprises a spacer, wherein the spacer extends into the dovetail receiving aperture when the engagement mechanism is in the extended configuration, thereby inhibiting rotation of the plurality of rotor blades within the rim slot.

Clause 9: The lock lug of any of the above clauses, wherein the lock lug includes a spring operable to extend the spacer into the dovetail receiving aperture.

Clause 10: A rotor disk assembly includes a rotor disk, a plurality of rotor blades, and a lock lug. The rotor disk includes a rim slot extending along a circumference of the rotor disk and a load slot intersecting the rim slot. The plurality of rotor blades are disposed within the rim slot of the rotor disk. The lock lug is disposed within the rim slot of the rotor disk and includes a body and an engagement mechanism. The body is sized and configured to be received within the rim slot of the rotor disk. The body defines a dovetail receiving aperture and is moveable between an assembly position and an engaged position. The dovetail receiving aperture receives a dovetail of the plurality of rotor blades when the body is in the assembly position and is offset from the dovetail when the body is in the engaged position. The engagement mechanism extends from the body and is operable to retain the body in the engaged position. The engagement mechanism has a retracted configuration that places the body in the assembly position within the rim slot to allow entry and exit of the dovetail of the plurality of rotor blades into and out of the dovetail receiving aperture and an extended configuration that places the body in the engaged position within the rim slot thereby offsetting the dovetail receiving aperture from the dovetail such that the dovetail is blocked from entering the dovetail receiving aperture.

Clause 11: The rotor disk of any of the above clauses, wherein the body of the lock lug includes a first sidewall, a second sidewall opposite the first sidewall, and a bottom portion extending between the first sidewall and the second sidewall.

Clause 12: The rotor disk of any of the above clauses, wherein the engagement mechanism extends from the bottom portion of the body and biases the body radially outward toward the engaged position.

Clause 13: The rotor disk of any of the above clauses, wherein the bottom portion inhibits rotation of the dovetail when the body is in the engaged position.

Clause 14: The rotor disk of any of the above clauses, wherein the engagement mechanism extends from the first sidewall and the second sidewall of the body.

Clause 15: The rotor disk of any of the above clauses, wherein the engagement mechanism includes a first spring disposed within the first sidewall and a first spacer adjacent to the first spring, wherein the first spring is operable to extend the first spacer into the dovetail receiving aperture.

Clause 16: The rotor disk of any of the above clauses, wherein the engagement mechanism includes a second spring disposed within the second sidewall and a second spacer adjacent to the second spring, wherein the second spring is operable to extend the second spacer into the dovetail receiving aperture Clause 17: The rotor disk of any of the above clauses, wherein the first sidewall extends into the load slot.

Clause 18: The rotor disk of any of the above clauses, wherein at least one of the plurality of rotor blades defines a platform notch disposed above the lock lug.

Clause 19: A rotor disk assembly comprising: rotational support means comprising a rim slot extending along a circumference of the rotational support means and a load slot intersecting the rim slot; and locking means located in the rim slot for blocking a dovetail of a plurality of rotor blades from exiting the rim slot.

Clause 20: The rotor disk assembly of any of the above clauses, wherein the locking means comprises a spring configured to bias the engagement mechanism toward an extended configuration.

Clause 21: A method of inhibiting movement of a plurality of rotor blades within a rim slot along a circumference of a rotor disk includes positioning a lock lug in an assembly position and inserting the lock lug into the rim slot of the rotor disk. The lock lug includes a body and an engagement mechanism. The body is sized and configured to be received within the rim slot of the rotor disk. The body defines a dovetail receiving aperture and is moveable between the assembly position and an engaged position. The dovetail receiving aperture receives a dovetail of the plurality of rotor blades when the body is in the assembly position and is offset from the dovetail when the body is in the engaged position. The engagement mechanism extends from the body and is operable to retain the body in the engaged position. The engagement mechanism has a retracted configuration that places the body in the assembly position within the rim slot to allow entry and exit of the dovetail of the plurality of rotor blades into and out of the dovetail receiving aperture and an extended configuration that places the body in the engaged position within the rim slot thereby offsetting the dovetail receiving aperture from the dovetail such that the dovetail is blocked from entering the dovetail receiving aperture.

Clause 22: The method of any of the above clauses further including activating the engagement mechanism of the lock lug, thereby retaining the lock lug in the engaged position.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A lock lug for inhibiting movement of a plurality of rotor blades within a rim slot along a circumference of a rotor disk, comprising:

a body sized and configured to be received within the rim slot of the rotor disk, the body comprising:

a first sidewall;

a second sidewall opposite the first sidewall;

a bottom that extends from the first sidewall to the second sidewall connecting the first and second sidewalls forming a dovetail receiving aperture configured to receive a dovetail of a rotor blade; and an engagement mechanism comprising a spring connected to one or more of the first sidewall, second sidewall and bottom, the engagement mechanism is configured to extend from the body and having (i) a retracted configuration configured to allow entry and exit of a dovetail of at least one or more of the plurality of rotor blades into and out of the dovetail receiving aperture and (ii) an extended configuration configured to block the dovetail from entering the dovetail receiving aperture.

2. The lock lug of claim 1, wherein the spring biases the engagement mechanism toward the extended configuration.

3. The lock lug of claim 1, wherein the engagement mechanism extends from the bottom of the body and biases the body radially outward.

4. The lock lug of claim 1, wherein the engagement mechanism comprises a spring, wherein the spring extends outward from the body when the engagement mechanism is in the extended configuration.

5. The lock lug of claim 1, further comprising a standoff extending radially upward from the body, wherein the standoff is operable to move the engagement mechanism from the extended configuration to the retracted configuration when depressed.

6. The lock lug of claim 1, wherein the engagement mechanism extends from the first sidewall of the body.

7. The lock lug of claim 1, wherein the engagement mechanism extends into the dovetail receiving aperture.

8. The lock lug of claim 1, wherein the engagement mechanism comprises a spacer, wherein the spacer extends into the dovetail receiving aperture when the engagement mechanism is in the extended configuration, thereby inhibiting rotation of the plurality of rotor blades within the rim slot.

9. The lock lug of claim 8, further comprising the spring operable to extend the spacer into the dovetail receiving aperture.

10. A rotor disk assembly comprising:

a rotor disk comprising a rim slot extending along a circumference of the rotor disk and a load slot intersecting the rim slot;

a plurality of rotor blades disposed within the rim slot of the rotor disk; and a lock lug disposed within the rim slot of the rotor disk, the lock lug comprising:

a body sized and configured to be received within the rim slot of the rotor disk, the body moveable between an assembly position and an engaged position, the body comprising:

a first sidewall;

a second sidewall opposite the first sidewall;

a bottom that extends from the first sidewall to the second sidewall connecting the first and second sidewalls forming a dovetail receiving aperture configured to receive a dovetail of a rotor blade, wherein the dovetail receiving aperture receives a dovetail of the plurality of rotor blades when the body is in the assembly position and is offset from the dovetail when the body is in the engaged position; and an engagement mechanism comprising a spring connected to one or more of the first sidewall, second sidewall and bottom, the engagement mechanism is configured to extend from the body and operable to retain the body in the engaged position, wherein the engagement mechanism has (i) a retracted configuration that places the body in the assembly position within the rim slot to allow entry and exit of the dovetail of the plurality of rotor blades into and out of the dovetail receiving aperture and (ii) an extended configuration that places the body in the engaged position within the rim slot thereby offsetting the dovetail receiving aperture from the dovetail such that the dovetail is blocked from entering the dovetail receiving aperture.

11. The rotor disk assembly of claim 10, wherein the engagement mechanism extends from the bottom of the body and biases the body radially outward toward the engaged position.

12. The rotor disk assembly of claim 10, wherein the bottom inhibits rotation of the dovetail when the body is in the engaged position.

13. The rotor disk assembly of claim 10, wherein the engagement mechanism extends from the first sidewall and the second sidewall of the body.

14. The rotor disk assembly of claim 10, wherein the engagement mechanism comprises a first spring disposed within the first sidewall and a first spacer adjacent to the first spring, wherein the first spring is operable to extend the first spacer into the dovetail receiving aperture.

15. The rotor disk assembly of claim 14, wherein the engagement mechanism further comprises a second spring disposed within the second sidewall and a second spacer adjacent to the second spring, wherein the second spring is operable to extend the second spacer into the dovetail receiving aperture.

16. The rotor disk assembly of claim 10, wherein the first sidewall extends into the load slot.

17. The rotor disk assembly of claim 10, wherein at least one of the plurality of rotor blades defines a platform notch disposed above the lock lug.

* * * * *